US006551164B1

(12) United States Patent
Motosko

(10) Patent No.: US 6,551,164 B1
(45) Date of Patent: Apr. 22, 2003

(54) TOY HORSE WITH SELF-STORABLE COMPONENTS THEREOF

(76) Inventor: Stephen J. Motosko, 132 Sand Dollar La., Sarasota, FL (US) 34242

( * ) Notice: Subject to any disclaimer, the term of this patent is extended or adjusted under 35 U.S.C. 154(b) by 0 days.

(21) Appl. No.: 10/139,914

(22) Filed: May 6, 2002

(51) Int. Cl.[7] ..... A63H 3/16

(52) U.S. Cl. ..... 446/97; 446/73; 280/1.13

(58) Field of Search ..... 446/97, 29, 100, 446/101, 102, 487, 69, 71–73, 75–76; 472/95–99, 132, 135; 296/177; D21/416–417, 428–429, 814, 828, 830; 280/1.16, 1.165, 1.22, 1.167, 1.23, 1.13, 1.188, 1.208, 1.206

(56) References Cited

U.S. PATENT DOCUMENTS

| | | | | | |
|---|---|---|---|---|---|
| 2,052,594 | A | * | 9/1936 | Antel | |
| 2,144,751 | A | * | 1/1939 | Brown | |
| 2,400,396 | A | | 5/1946 | Denton | |
| 3,018,583 | A | * | 1/1962 | Novotney | |
| 3,090,618 | A | | 5/1963 | Brent | |
| 3,139,698 | A | * | 7/1964 | Arnold | |
| 3,155,390 | A | | 11/1964 | Moore | |
| 3,224,723 | A | | 12/1965 | Moore | |
| 3,319,957 | A | | 5/1967 | Ryan | |
| 3,375,604 | A | * | 4/1968 | Alonso | |
| 3,423,085 | A | | 1/1969 | Koller | |
| 3,952,449 | A | * | 4/1976 | Terzian | 46/161 |
| 3,999,771 | A | | 12/1976 | Lohr | |
| 4,186,515 | A | * | 2/1980 | Ogawa | 46/22 |
| 4,265,461 | A | * | 5/1981 | Okubo | 280/1.13 |
| 4,497,500 | A | * | 2/1985 | Mercurio | 280/1.13 |
| 4,575,072 | A | | 3/1986 | Russell | |
| 4,690,397 | A | | 9/1987 | Abed | |
| 4,722,537 | A | | 2/1988 | Chau-Pin | |
| 5,328,410 | A | | 7/1994 | Amburgey | |
| 5,788,554 | A | * | 8/1998 | Goodwin et al. | 446/100 |
| 5,980,260 | A | * | 11/1999 | Caputi | 434/295 |
| 6,036,604 | A | | 3/2000 | Klitsner | |
| 6,234,858 | B1 | * | 5/2001 | Nix | 446/97 |

* cited by examiner

*Primary Examiner*—Derris H. Banks
*Assistant Examiner*—Jamila Williams
(74) *Attorney, Agent, or Firm*—Charles J. Prescott

(57) ABSTRACT

A three dimensional toy horse formed of separate connectable parts and being suitable for incorporation into children's riding and hobby horse toys. The toy horse includes a substantially hollow main horse body having a neck opening and front and rear leg receiving portions. A horse head is matingly connectable to the neck opening as are the front and rear legs, which are connectable to corresponding front and rear leg receiving portions. The main horse body has a hollow interior volume sized to receive and store the horse head therein and also preferably, the front and rear legs for economy of shipping and storage space thereof.

3 Claims, 3 Drawing Sheets

TOY HORSE WITH SELF-STORABLE COMPONENTS THEREOF

BACKGROUND OF THE INVENTION

1. Scope of Invention

This invention relates generally to the field of toy riding and hobby horses, and more particularly to a three-dimensional toy horse having separable body components with substantially enhanced storage features for shipping economy.

2. Prior Art

The toy children's riding and hobby horse has been popular for decades. These toy horses have been incorporated into children's ferris wheels, hobby horses and rollable riding horses of various ridable sizes and configurations. One such device is disclosed by Koller in U.S. Pat. No. 3,423,085 which teaches a resiliently supported hobby horse mounted on pivotable links.

Another hobby horse is taught by Moore in U.S. Pat. No. 3,155,390. In this disclosure, the spring supported hobby horse includes front and rear pivoted legs for simultaneous leg movement with hobby horse motion.

Yet another children's hobby horse is disclosed in U.S. Pat. No. 2,400,396 invented by Denton. This invention is a somewhat two-dimensional representation of a horse wherein a handle through the horses head connected to supporting rope members and a third rope support connected to the tail of the horse allow for riding use by a child wherein the front and rear legs are pivotably movable for enhanced enjoyment.

A knock-down toy horse is disclosed in U.S. Pat. No. 4,722,537 invented by Chau-Pin which teaches a rigid structure assembled of components with appropriate tenons and mortises for shipping economy and then for repeated erection and dismantlement by children for educational purposes.

Ryan, in U.S. Pat. No. 3,319,957 teaches a rocking horse with moving legs while the following U.S. Patents also teach variations of toy rocking horses and hobby horses for children's action play.

U.S. Pat. 3,090,618 to Brent

U.S. Pat. 4,575,072 to Russell

U.S. Pat. 3,224,723 to Moore

U.S. Pat. 3,999,771 to Lohr

U.S. Pat. 6,036,604 to Klitsner

U.S. Pat. 4,690,397 to Abed

U.S. Pat. 5,328,410 to Amburgey.

The present invention teaches a toy horse of the ridable size for children in various forms with enhanced shipping economy by structurally permitting storage of the attachable head member and front and rear legs within the hollow interior volume of the main horse body or torso itself.

BRIEF SUMMARY OF THE INVENTION

This invention is directed to a three dimensional toy horse formed of separate connectable parts and being suitable for incorporation into children's riding and hobby horse toys. The toy horse includes a substantially hollow main horse body having a neck opening and front and rear leg receiving portions. A horse head is matingly connectable to the neck opening as are the front and rear legs, which are connectable to corresponding front and rear leg receiving portions. The main horse body has a hollow interior volume sized to receive and store the horse head therein and also preferably, the front and rear legs for economy of shipping and storage space thereof.

It is therefore an object of this invention to provide a three-dimensional toy horse with substantial shipping advantage offered by the means of component storage thereof.

It is another object of this invention to provide a three-dimensional toy horse of the ridable size by children which may be incorporated into any of various children's toy horses such as that of a hobby horse, a rollable ground-supported toy horse and various action rides and which is easily assemblable with minimal structural component features requiring assembly.

It is still another object of this invention to provide a three-dimensional toy horse wherein, prior to their attachment to the hollow main body, the head member and the front and rear leg members are storable within the main body of the horse for substantial economy of shipment.

In accordance with these and other objects which will become apparent hereinafter, the instant invention will now be described with reference to the accompanying drawings.

DETAILED DESCRIPTION OF THE INVENTION

Figure 1:
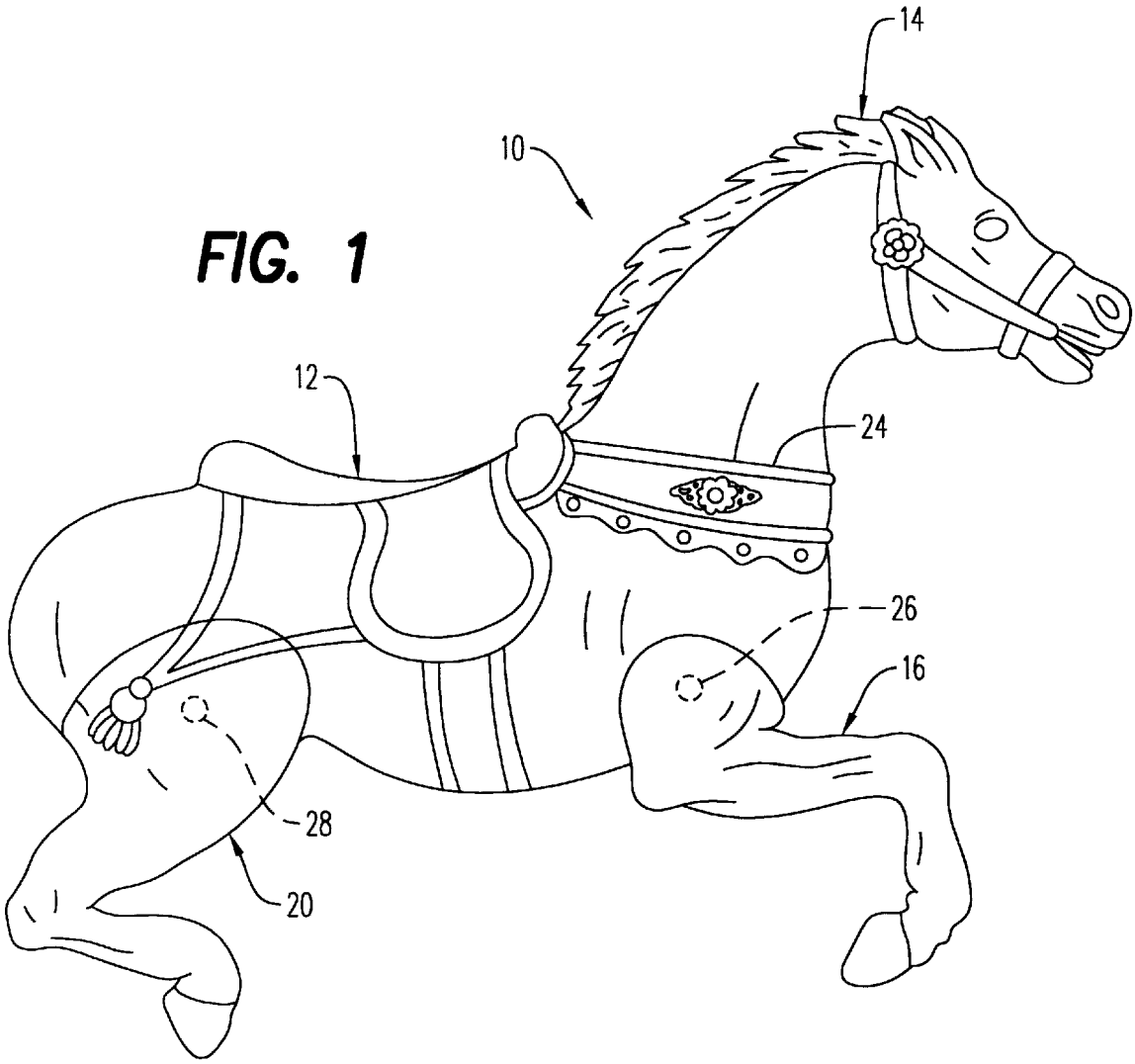
FIG. 1 is a side elevation view of the invention in its assembled configuration.
Figure 2:
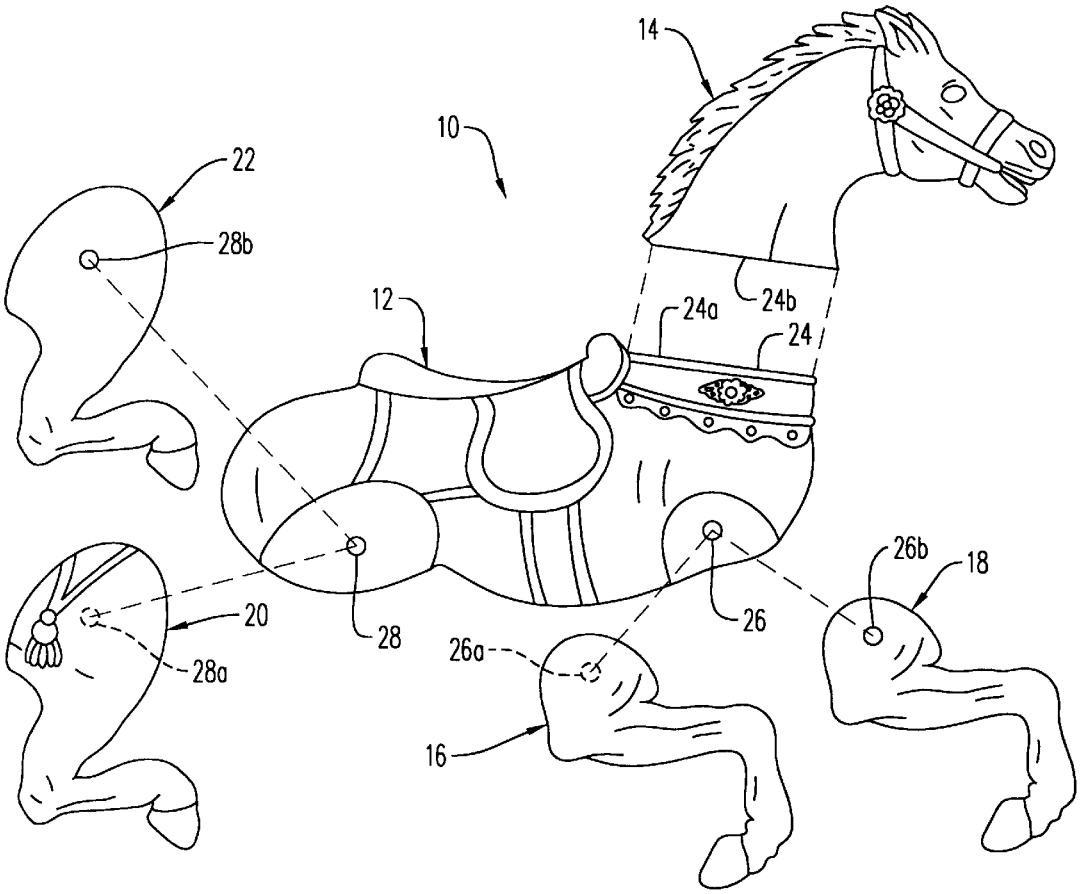
FIG. 2 is an exploded view of the invention of FIG. 1 showing the main component members thereof.

Referring now to the drawings, and firstly to FIGS. 1 and 2, the invention is there shown generally at numeral 10. The toy horse 10 includes a substantially hollow main horse body 12 formed as a thin hollow shell from fiberglass or plastic molding with exterior ornamental and design features and configuration of a toy horse. The interior of the main horse body 12 is substantially hollow, having a neck opening 24 defined by a perimeter or margin 24*a* providing access into the interior volume thereof.

The invention 10 also includes a head of a horse 14, again having the exterior ornamental features of a horse, including the harness and mane of the horse head 14. The horse head 14 is also formed of molded fiberglass or plastic and having a substantially hollow interior for weight and material cost economy. A lower margin 24*b* is matingly compatible with the margin 24*a* of opening 24 so that, as best seen in FIG. 2, the horse head 14 may be attachable to the neck opening 24 for mating engagement with perimeter 24*a*. Attachment by the end user or retailer may be effected by mechanical fasteners, by adhesively, a snap-fit arrangement or by other well known means of attachment as desired by the manufacturer.

The invention 10 further includes two separate, connectable front legs 16 and 18 and two separate rear legs 20 and 22. Each of these legs 16, 18, 20 and 22 are formed of molded plastic or fiberglass and are generally three-dimensional and hollow for manufacturing and weight economy and include the exterior ornamental features typical of a toy horse as shown.

The front legs 16 and 18 are connectable about a transverse pin or shaft (not shown) positioned within mounting aperture 26 wherein the mounting ahaft is slidably engageable into, and lockable within, mating cavities 26*a* and 26*b* in the front legs 16 and 18, respectively. Likewise, the rear legs 20 and 22 are attachable to the main horse body 12 through aperture 28 and a rear leg mounting shaft (not shown) which interengages and is lockable within cavities 28*a* and 28*b* of rear legs 20 and 22 respectively.

Figure 3:
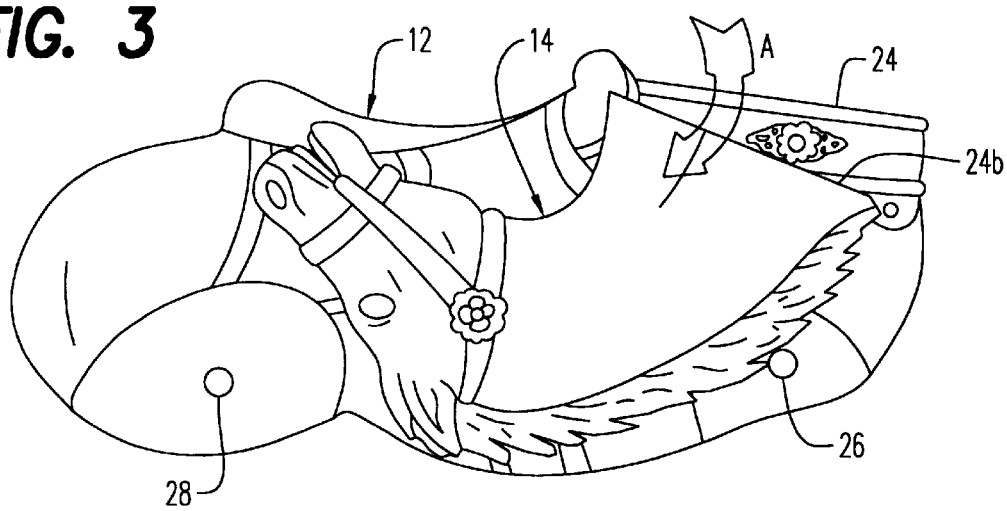
FIG. 3 is a simple schematic view of one compact shipping aspect of the invention showing the horse head positioned within the interior volume of the main hollow horse body or torso.

Referring now to FIG. 3, one option presented by the present invention for storage and shipping economy is there shown. The horse head 14 is inserted fully into the hollow interior volume of the main horse body 12 in the direction of arrow A through the neck opening 24.

Figure 4:
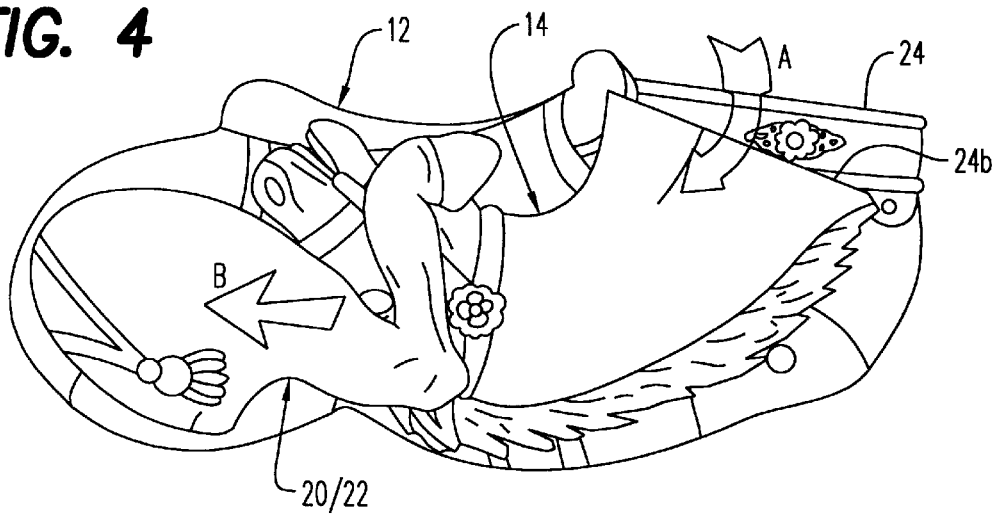
FIG. 4 is a view similar to FIG. 3 showing the additional storage of the rear legs of the toy horse of FIG. 1.

In FIG. 4, the same storage arrangement of the horse head 14 is there shown. However, prior to storage insertion of the horse head 14 into the hollow interior of the main horse body 12, the rear legs 20 and 22 have first been inserted in the direction of arrow B all the way up to the closed rear end of the horse body 14 after which the horse head 14 is positioned as shown partially between the rear legs 20 and 22.

Figure 5:
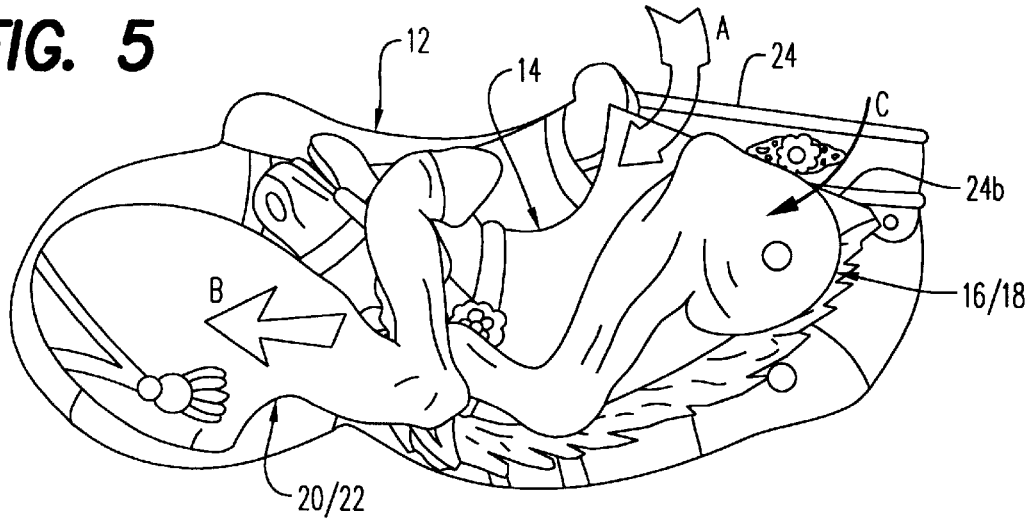
FIG. 5 is a view similar to FIG. 4 showing the additional storage of the front legs of the toy horse of FIG. 1.

A final storage feature of the present invention is demonstrated in FIG. 5 wherein the front legs 16/18 are inserted fully into the interior volume of the main horse body 12 in the direction of arrow C after the rear legs 20 and 22 have been inserted therein, followed by the insertion of horse head 14 therein as shown.

By this arrangement, all of the components of the present invention 10 are storable within the hollow horse body 12, including accessory fasteners, instructions and the like. Moreover, the overall container for storing and shipping of the dismantled or pre-assembled version of the invention 10 requires a substantially smaller sized container for its boxing and shipment.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A three dimensional toy children's riding horse formed of separate connectable parts, comprising:

a substantially hollow main horse body having a neck opening and front and rear leg receiving portions and being sized and configured to support the weight of a child positioned thereupon in a seated riding position;

a horse head matingly connectable to said neck opening;

front and rear legs connectable to corresponding said front and rear leg receiving portions;

said main horse body having a hollow interior volume sized to receive and store said horse head therein for economy of shipping and storage space thereof.

2. A three dimensional children's toy riding and hobby horse formed of separate connectable parts, comprising:

a substantially hollow main horse body being sized and configured to support the weight of a child in horse-riding fashion thereatop and having a neck opening and front and rear leg receiving portions;

a horse head matingly connectable to said neck opening;

front and rear legs connectable to corresponding said front and rear leg receiving portions;

said main horse body having a hollow interior volume sized to receive and store said horse head and said rear legs therein for economy of shipping and storage space thereof.

3. A three dimensional toy riding horse formed of separate rigid connectable parts forming a children's riding and hobby horse toy, comprising:

a substantially hollow main horse body having a neck opening and front and rear leg receiving portions;

a horse head matingly connectable to said neck opening;

front and rear legs connectable to corresponding said front and rear leg receiving portions;

said main horse body having a hollow interior volume sized to receive and store said horse head and said front and rear legs therein for economy of shipping and storage space thereof;

said toy horse being sized and configured to support the weight of a child in a seated fashion, and is thereby ridable by children.

* * * * *